United States Patent [19]

Schmitt

[11] Patent Number: 5,004,297

[45] Date of Patent: Apr. 2, 1991

[54] PORTABLE, SAFETY, PLAY CHAIR

[76] Inventor: Marcella H. Schmitt, 190 S. Wood Dale Rd. #706, Wood Dale, Ill. 60191

[21] Appl. No.: 376,417

[22] Filed: Jul. 7, 1989

Related U.S. Application Data

[63] Continuation-in-part of Ser. No. 328,088, Mar. 23, 1989.

[51] Int. Cl.[5] ..... A42C 3/02

[52] U.S. Cl. ..... 297/270; 272/56.5 R; 272/113

[58] Field of Search ..... 272/113, 56.5 R; 297/247, 270

[56] References Cited

U.S. PATENT DOCUMENTS

| | | | |
|---|---|---|---|
| 207,105 | 3/1867 | Gale . | |
| 211,588 | 7/1868 | Zick . | |
| 213,273 | 1/1869 | Wormser . | |
| 217,486 | 5/1870 | McHugh . | |
| 222,156 | 10/1871 | Miller . | |
| 232,240 | 7/1874 | Markusen . | |
| 232,241 | 7/1874 | Markusen . | |
| 232,249 | 7/1874 | Markusen . | |
| 232,314 | 8/1874 | Markusen . | |
| 238,889 | 2/1876 | Holmquist . | |
| 244,556 | 5/1877 | Burgess et al. . | |
| 244,788 | 6/1877 | Burgess et al. . | |
| 250,784 | 1/1879 | Dieter et al. . | |
| 269,104 | 5/1883 | Brown . | |
| 269,105 | 5/1883 | Brown . | |
| 269,106 | 5/1883 | Brown . | |
| 269,107 | 5/1883 | Brown . | |
| 291,717 | 9/1887 | Brooks . | |
| 1,917,018 | 7/1933 | Clark . | |
| 2,170,935 | 8/1939 | Whiteley . | |
| 2,465,187 | 3/1949 | Barrabee . | |
| 3,632,109 | 1/1972 | Dattner . | |
| 3,663,346 | 5/1972 | Schoen . | |
| 3,663,347 | 5/1972 | Schoen . | |
| 3,666,266 | 5/1972 | Noguchi . | |
| 3,687,449 | 8/1972 | Newman . | |
| 3,730,522 | 5/1973 | Packowski . | |
| 3,765,121 | 10/1973 | Vennola . | |
| 3,780,469 | 12/1973 | Hancovsky | 272/113 X |
| 3,802,133 | 4/1974 | Gregory . | |
| 3,895,796 | 7/1975 | Pestalozzi . | |
| 3,928,701 | 12/1975 | Roehner . | |
| 3,947,024 | 3/1976 | Slater . | |
| 3,949,985 | 4/1976 | Stampfli . | |
| 4,063,725 | 12/1977 | Snyder . | |
| 4,343,464 | 8/1982 | Dose . | |
| 4,369,965 | 1/1983 | Abrens . | |
| 4,379,551 | 4/1983 | Ahrens . | |
| 4,487,411 | 12/1984 | Ahrens . | |
| 4,546,965 | 10/1985 | Baxter et al. . | |
| 4,629,182 | 12/1986 | Rader et al. . | |
| 4,721,299 | 1/1988 | Schlientz . | |

OTHER PUBLICATIONS

Whitney Brothers Co. Product Catalog ©1970, p. 3.
"Evening Star", Feb. 10, 1973, p. A-3.
Sweets Architect, File, 1977, Sec. 2.15/mi.
Playscape Incorporated, 12/11/68.
Miracle Recreation Equip. Co. Catalog 773.
Popular Science, Jun., 1983, p. 104.

*Primary Examiner*—Richard E. Chilcot, Jr.
*Attorney, Agent, or Firm*—Potthast & Ring

[57] ABSTRACT

A portable, safety, play chair (10) of molded plastic construction with a chair body made (11) of a relatively thin cylindrical wall (12) with openings (16R, 16L) on either side for receipt of a child ages 3-6 and a base (18R, 18L ) for supporting the cylindrical wall (12) against tipping or rolling. The thin cylindrical wall (12) is reinforced adjacent the openings (16R, 16L) by crescent shaped, inwardly turned rib (28) forming arches that are supported at opposite front and back by a pair of L-shaped legs (22F, 22B) which extend forwardly and rearwardly beyond the front (12F) and back (12D) of the cylindrical wall (12) for enhanced support against rolling, while an elongate underlying foot member (20) extends laterally of the sides of the cylindrical wall (12) for enhanced protection against tipping as well as provision of a support for a person's foot. The entire space between the L-shaped legs is also interconnected by planar material (26B, 26F) joined to the edge of the opening (16R, 16L) for enhanced strength and to eliminate crevices in which a child may become wedged. A rim assembly has an outwardly extending slanted segment (34) interconnecting a rim member (24) to the rib (28) to provide a hand grip of varying dimension.

25 Claims, 1 Drawing Sheet

PORTABLE, SAFETY, PLAY CHAIR

CROSS REFERENCE TO RELATED APPLICATION

This application is a continuation-in-part of U.S. application Ser. No. 07/328,088, filed Mar. 23, 1989, and entitled "Portable, Safety, Play Furniture Assembly".

BACKGROUND OF THE INVENTION

This invention relates to a portable, safety, play furniture assembly, or chair, and, more particularly, to such a chair having a closed, inwardly curved wall forming a chair body for underlying support of a person reposed therein.

Various types of play structures or devices are known which include a cylindrical body within which children may crawl, scramble or otherwise interactively play. In U.S. Pat. No. 3,730,522, issued May 1, 1973 to Paczkowski, a child's amusement toy is shown with a rocking base, a hollow center and circular holes or tunnels through which a child can crawl into and out of the center. An A-shaped playground climber is shown in U.S. Pat. No. 4,369,965, issued Jan. 25, 1983, to Ahrens to which cylindrical tubes, as well as a slide and climbing stairs, are attached. A brochure of Playscape Incorporated, dated Dec. 11, 1968, discloses a segmented outdoor tube with openings for walking and playing in, and in the Jun. 1983 issue of Popular Science at page 104 a swingset with playhouse is shown with an elongate cylindrical tunnel mounted on a hill. In both Sweets Architect Catalog, Section 2.15/mi, 1977 file, and in Miracle Recreation Equipment Catalog 773, copyright 1972, page 51, rotatable cylindrical bodies are shown within which a child may walk.

Other cylindrical or other tubular slides, tunnels and clamber toys in U.S. Pat. Nos. 2,170,935 issued Aug. 29, 1939 to Whiteley; 2,465,187 issued Mar. 22, 1949 to Barrabee; 3,928,701 issued Dec. 23, 1975 to Roehner; 3,497,024 issued Mar. 30, 1976 to Slater; 3,949,985 issued Apr. 13, 1976 to Stampfli; 4,379,551 issued Apr. 12, 1983 to Ahrens; Des. 244,556 issued May 31, 1977 to Burgess et al.; Des. 269,104 issued May 24, 1983 to Brown; Des. 291,717 issued Sept. 1, 1987 to Brooks; and German Patent No. 566,161 dated Sept. 15, 1975.

While these various playground toys appear to be useful for play, they generally lack the combined qualities of safety, portability, and small size needed for indoor use as a toy or as a child's chair.

It has been discovered through observation of children, particularly those in age group 3-6, that they particularly enjoy sitting within relatively narrow arcuate, concave, closed structures which are sufficiently small that they can lie on their backs and slide around a smooth concave interior surface by pushing against the interior surface with their feet or by "walking" with their knees in a raised position to pull themselves along the cylindrical surface. In this way, they can both easily shift the position of their torso from horizontal to upright to head over heels through unorthodox methods of sliding which they enjoy. At the same time, it is observed that they enjoy reposing within a partially enclosed surface with respect to surfaces immediately in front and above them but which are not so enclosed as to block light or peripheral vision on all sides.

The known structures discussed above fail to provide these capabilities. Many are too rough for sliding while others rotate to defeat sliding movement. Others of the known structures are elevated off the ground and they create a risk of injury, while still others present safety problems due to possible tipping or due to crevices into which a child's limb or neck can become wedged.

Accordingly, in parent U.S. Pat. application Ser. No. 07/328,088, filed Mar. 23, 1989, an improved portable, safety, play furniture assembly is disclosed and claimed which overcomes these disadvantages. Reference should be made to the specification, drawings and claims of this parent application for the details of this basic invention which is hereby incorporated herein.

Since the filing of that parent application, an improved thin wall design has been developed which facilitates manufacturing of same by means of rotational molding with a minimum of plastic material (polyethylene, polyvinyl or the like) for minimum costs of manufacturing and maximum portability while still providing the strength, rigidity and stability needed for safety. Other important features have been added.

It is important from a safety viewpoint to reduce tipping in a sideways direction and for this purpose a foot has been provided with an element extending laterally of the chair body. A potential difficulty with this foot was that its height made it unsuitable as a foot rest and because it extended laterally of the entire chair body; further its height created an obstacle over which a person walking by the side of the furniture assembly could trip, since it extended laterally of the entire chair body in addition to extending laterally of the entire body of the assembly.

The prior design also required a thick wall or double thin wall, construction to achieve the rigidity on the top, overlying part of the chair body to prevent its collapse from weight placed on the top or when the top edge is grabbed by a person when lowering himself into the chair. This thickness required excessive quantities of material adding to the weight and reducing the stability of the furniture assembly as well as creating an edge which had no vertical element to enhance its function as a hand grip.

SUMMARY OF THE INVENTION

It is therefore an object of the present invention to provide a portable, safety, play furniture assembly, or chair, which facilitates construction with a maximum of plastic material while overcoming the disadvantages of the earlier basic design of the parent application noted above and of the prior known designs.

This objective is achieved in part by providing a portable, safety, play chair with a chair body for repose of a person therewithin and a unique base for supporting the chair body against tipping and rolling movement. The chair body includes a smoothly curved wall closed inwardly upon itself to form upper and lower portions extending between a pair of opposite sides of the wall, and an opening at least one of said sides of the wall for entry of a person to repose within the closed curved wall. The base includes a relatively thin, substantially planar foot attached to the lower portion of the current wall in underlying relationship therewith and extending laterally from the one side of the wall to resist lateral tipping of the chair body.

In the preferred embodiment, the foot includes an elongate foot member which extends beyond a front and a back side of the current closed wall for support of a person's foot thereon. Advantageously, the leg joining the foot to the chair body and the foot member, itself, are coextensive with the chair body to eliminate any crevices or small openings within which a child might become wedged. The risk of a person tripping over the laterally extending foot is reduced, at least, in part, due to the upper portion of the chair body being provided with a rim around the opening at the side of the wall which extends laterally therefrom by an amount not less than the lateral extension of said foot from the side of the wall.

In keeping with another aspect of the invention, the need for a double wall form of construction or a thick wall form of construction for the top portion of the chair body is eliminated by provision of a unique rib attached to inwardly curved wall adjacent the opening which extends inwardly therefrom to reinforce an upper portion of a relatively thin upper portion of the inwardly curved wall. In the preferred embodiment, the rib is in the form of a crescent shaped arch defined by a pair of intersecting circles.

This rib forms part of a reinforcing rim assembly which has an outwardly turned, beveled wall forming a hand grip for a person to raise and lower themselves into the chair body. In keeping with another aspect of the invention, the hand grip accommodates hands of different sizes. Preferably, the beveled wall varies in width to provide a relatively narrow hand grip at an upper section of the rim and a relatively wider hand grip at a lower section of the rim. In addition, preferably the hand grip has a depth which gradually varies from a relatively deep level adjacent the relatively narrow hand grip at the relatively lower section of the rim to a relatively shallow level adjacent the relatively wider hand grip at the relatively lower section of the rim.

BRIEF DESCRIPTION OF THE DRAWINGS

The foregoing objects and advantageous features will be described in detail and other objects, features and advantages of the invention will be made apparent from the detailed description of the preferred embodiment which is given with reference to the following figures of the drawing, in which.

DETAILED DESCRIPTION

Figure 1:
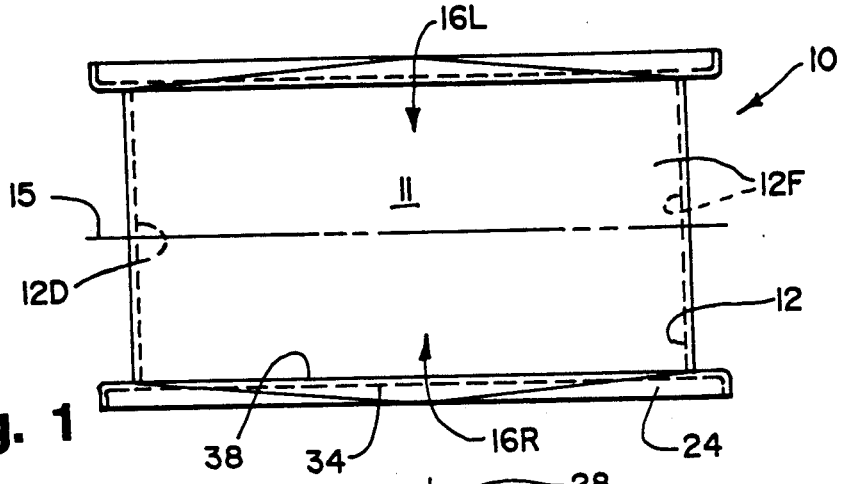
FIG. 1 is a top view of the preferred embodiment of the portable, safety, play chair of the present invention.
Figure 2:
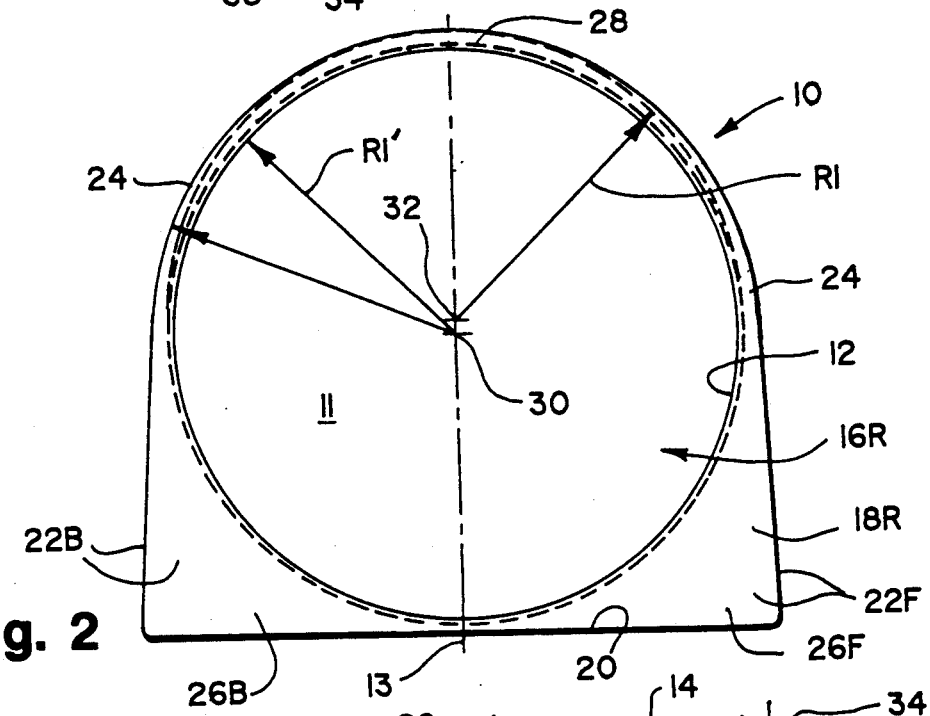
FIG. 2 is a view of either side of the preferred embodiment of FIG. 1, both sides being identical.
Figure 3:
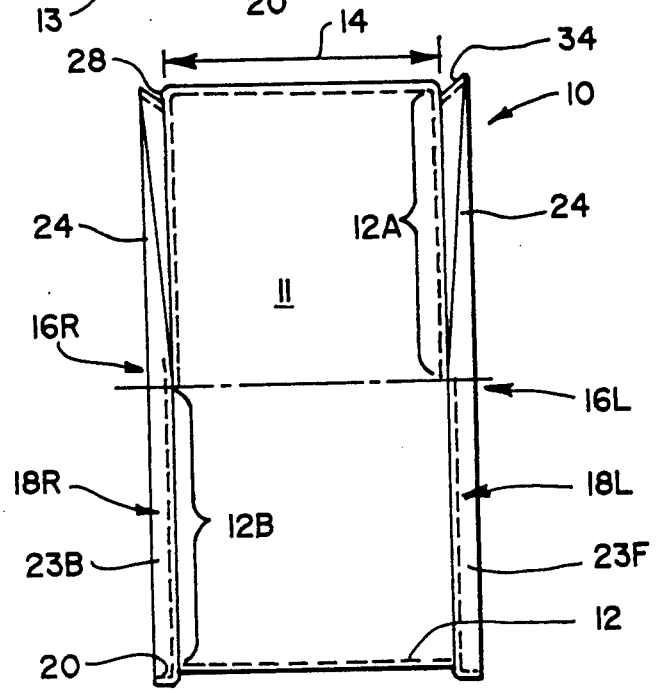
FIG. 3 is the front view of the preferred embodiment of FIGS. 1 and 2, which is identical to a back view, both back and front being identical.

Referring now to the FIGS. 1, 2 and 3 of the drawing, the preferred embodiment of the portable, safety, play chair 10 has a chair body 11 with smooth, glass-like, impact and splinter resistant, closed, concave or inwardly curved interior wall, or curved wall, 12 closed inwardly upon itself to form an upper portion 12A above and a lower portion 12B of the chair body 11, FIG. 3. The wall 12 is preferably of uniform width 14 throughout and has an interior cylindrical surface at least in the lower portion 12B, if not throughout. In such case, openings 16R and 16L on opposite sides of the wall 12 are circular, having a radius R1 of approximately fifteen inches for a width 14 of approximatley fifteen inches. This has been found to be the optimum size and ratio between width 14 and opening size for children from ages three to six years to give them both comfort and a sense of security.

The entire chair is of a thin wall construction being made of relatively thin walls having a thickness on the order of less than two orders of magnitude less than the diameter of the openings 16R and 16L in order to minimize the weight of the chair 10 to enhance portability and to reduce the cost of material. The nominal wall thickness is approximately one-eighth inch for a radius R1 of approximately fifteen inches. The material is preferably polyethylene, polyvinyl or other like impact resistance, relatively rigid, smooth plastic. On the other hand, it is of particular importance to keep the weight of the top portion 12A as low as possible in order to optimize stability of the chair, but the top portion must also have sufficient strength to preclude inward collapse under normal loading conditions. The entire clair 10 is preferably manufactured as a single integrated item by means of molding, preferably, rotational molding.

While both openings 16R and 16L are preferably provided, the chair 10 can also be made with a wall (not shown), either opaque, translucent or transparent, in place of one of the openings 16R and 16L. Also, while the openings 16R and 16L are preferably coextensive with lower portion 12B of the interior space, defined by the bottom portion 12B of wall 12, the openings 16R and 16L are somewhat smaller than the interior space defined by the upper portion 12A of wall 12. This reduction in the upper portion 12A enhances the feeling of security while not affecting coextensive openings on the lower portion 12B and ease of entry of a child into the interior space defined by wall 12. As a minimum, at least one opening 16R and 16L must be provided of sufficient size to enable entry of a child or other person to repose within the curved wall 12.

The chair body 11 is supported against tipping and rolling movement by means of a base having a pair of mirror imaged, but otherwise identical, base sections 18L and 18R at the left and right sides, respectively. Generally, the chair 10 has a plane of symetry 13, FIG. 2, passing vertically through the middle of the side and another plane of symetry 15, FIG. 1, passing vertically through the chair 10 midway between openings 16R and 16L.

Referring to base section 18R, for instance, seen in both FIGS. 3 and 2, it has an elongate, substantial planar foot member 20 attached to the lower portion 12B of the curved wall 12 in underlying relationship therewith and extending laterally outwardly from the opening 16R and the right side of wall 12. This lateral offset assures that the weight of a child reposed on the lower portion 12D, of wall 12 cannot be shifted outside of the foot 20 to cause the chair to tip sideways. The foot member 20, like the remainder of the chair 10, is formed of a thin wall of approximately one-eighth inch to provide a flat upper surface which is nearly flush with an underlying floor surface (not shown).

Similarly, to prevent tipping or rolling in a back and forth direction, the foot member 20 extends backward beyond the back most surface 12B of the wall 12 and extends forward beyond the front most surface 12F by a significant amount, as best seen in FIGS. 1 and 2. In the case of a radius R1 of fifteen inches, an extension of the foot member 20 of approximately two inches at both the front and back has been found sufficient, while an extension of approximately one and one-fourth inches has been found sufficient for the lateral offset of foot member 20.

The foot member 20 is attached to the one side of wall 12 by means of a front leg 22F at the front end of the foot member 22 and a back leg 22B at the back end of the elongate foot member 20. Both legs 22F and 22B have an L-shaped cross section for enhanced strength. One part, 23F and 23B, FIG. 3, of each L extends laterally from the opening 16R by an amount substantially equal to the lateral extent of the underlying foot 20. This enhances strength and also reduces any chance of a person tripping over foot member 22 as they walk by the side of the chair 10. These laterally extending parts 23F and 23B are elongate and slanted slightly inwardly toward each other from the opposite ends of the foot member 20 to merge into and support the opposite sides of a semi-circular arch of a rim 24 attached around the upper portion 12A of the wall 12.

The other part, 26B and 26F, of each of the L-shaped legs 22F and 22B is secured to the lower portion 12B adjacent the opening 16R and extends downwardly therefrom to join the elongate foot member 20 along its entire length between the lateral parts 23F and 23B of the legs 22F and 22B, respectively. The downwardly extending parts 26B and 26F of the legs 22B and 22F are substantially planar and coextensive to eliminate gaps or holes in which a child may become caught. They join both the foot member 20 and the laterally extending parts of the L-shaped legs at substantially right angles for optimum strength and are preferably integrally formed therewith. In addition, the two parts 26B and 26F are preferably integrally formed together or otherwise joined to interconnect the two lateral parts of the legs 22F and 22B. This interconneciton prevents the legs from spreading apart when loaded and supports the side of the wall 12 around the entire periphery of the lower portion 12B for maximum support with minimum material.

As best seen in FIG. 3, the lowermost part of the curved wall 12 is elevated above any underlying support surface by the base 18 by a slight amount, approximately three-fourths inch, in order to maximize the normal load of foot 20 on the underlying floor surface. This maximizes the load on the foot 20 for increased friction with the underlying floor to reduce sliding.

As previously noted, the wall 12 is a thin wall of approximately one-eighth inch thickness to reduce the material required and to lower the center of gravity of the chair body 11 for enhanced stability. However, it is also necessary for the upper portion 12A of the wall 12 to have sufficient strength to prevent collapse in the event of top loading by means of a person sitting on top, for instance. In keeping with another important aspect of the invention, both the thin wall construction and the necessary strength against collapse is achieved by means of a thin walled, crescent shaped rib 28 attached to the upper portion 12A of the wall 12 adjacent the opening 16R and extending inwardly therefrom.

Advantageously, this rib 28 is formed entirely in the upper portion. It is defined by the crescent resulting from intersection of the circle of radius R1 which defines the upper portion 12A of wall 12 and another circle of a radius R1' which is the same length as radius R1 but which is centered at a point 30 vertically offset immediately below the center 32 of the circle of radius R1 by an offset distance of approximately one inch. This offset distance equal to the maximum depth of the rib 28 is also approximately equal to the difference in the length of the radius R1 and a radius R1 which defines the outermost edge of the rim assembly, or rim, 24. Thus, the depth gradually varies from a maximum at the uppermost part of the upper portion 12A where maximum strength is required to a minimum, or zero depth, at approximately midpoint where reinforcement against vertical loads is no longer required. The rib 28 merges at the back and front with the laterally offset parts 23B and 23F of the base and disappears, as seen best in FIGS. 2 and 3.

Interconnecting the inwardly turned rib 28 and the rim 24 is a beveled wall 34 which starts, or turns, outwardly from the base of the rib 28 to the outermost edge of the rim 24. Advantageously, achieving another objective of the invention, this beveled wall 34 forms part of a convenient hand grip for a child to raise and lower themselves through the opening 16R or 16L. As seen, the rim 24 which extends laterally outward from the side of the curved wall 12 has a narrowed segment adjacent the top and gradually increases in width as the level decreases.

While a preferred embodiment has been disclosed in detail, it should be appreciated that the scope of the invention is not so limited, but is defined by the appended claims.

I claim:

1. A portable, safety, play chair, comprising: a chair body including a smoothly curved wall closed inwardly upon itself to form upper and lower portions having a length and extending between a pair of opposite sides of the wall, and an opening at one of said sides of the wall for entry of a person to repose within the closed curved wall; and a base for supporting the chair body against tipping and rolling movement including a relatively thin, substantially planar foot attached to the lower portion of the curved wall in underlying relationship therewith and extending across said length and laterally from the one side of the wall to resist tipping of the chair body.

2. The portable, safety, play chair of claim 1 in which at least the lower portion of said curved wall has an interior surface which is substantially cylindrical.

3. The portable, safety, play chair of claim 1 in which said chair body has another opening at the other of said pair of opposite sides of the wall, and said base includes another foot attached to the lower portion of the curved wall in underlying relationship therewith which extends laterally from the other one of said pair of opposite sides of the wall.

4. The portable, safety, play chair of claim 1 in which said chair body has a front and a back and said foot includes an elongate foot member which extends between a front and a back of the curved closed wall, said foot member laterally extending beyond the one side substantially along its entire length.

5. The portable, safety, play chair of claim 4 in which said elongate foot member extends beyond the front and beyond the back of the chair body at parts thereof which also extend laterally from the side of the chair body.

6. The portable, safety, play chair of claim 1 in which said foot is relatively thin and has an upper substantially planar surface adjacent the opening for support of a person's foot when reposing within the closed curved wall.

7. The portable, safety, play chair of claim 1 in which said base includes a leg with an L-shaped cross section having one part of the L extending laterally of the one side, and another part which is secured to the one side of the curved wall adjacent the opening and extends downwardly to join said foot in substantially transverse relationship therewith.

8. The portable, safety, play chair of claim 7 in which said downwardly extending part of the L-shaped leg is a substantially planar sheet interconnected to the one side of the inwardly curved wall around substantially the entire periphery of the opening.

9. The portable, safety, play chair of claim 1 including an arch-shaped rim attached to the upper portion of the curved wall around the opening supported at opposite ends by a pair of legs interconnecting the inwardly curved wall with the foot.

10. The portable, safety, play chair of claim 9 in which at least the upper portion of said chair body has a peripheral rim around the opening at said one side of the wall which extends laterally therefrom by an amount not less than the lateral extension of said foot from said one side of the wall.

11. The portable, safety, play chair of claim 10 including an inwardly turned reinforcing rib connecting the rim to the upper portion of the curved wall.

12. A portable, safety, play chair, comprising:

a chair body having a smoothly curved wall closed upon itself to form upper and lower portions for surrounding a person, and an opening at one of a pair of opposite sides of said wall for receipt of a person therewithin;

a rib attached to the curved wall adjacent the opening and extending inwardly therefrom to reinforce an upper portion of said wall against inward deflection; and a base for supporting the cylindrical body and the rib against tipping or rolling movement.

13. The portable, safety, play chair of claim 12 in which the lower portion of said inwardly curved closed wall has an interior surface which is substantially cylindrical.

14. The portable, safety play chair of claim 12 in which said inwardly extending rib has a depth which varies from a maximum at an uppermost part of the upper portion to a minimum adjacent a lowermost part of the upper portion.

15. The portable, safety, play chair of claim 14 in which said rib is an arch having two sides which are defined by a pair of intersecting circles having radii which are offset from each other by an amount approximately equal to said maximum depth.

16. The portable, safety, play chair of claim 1 including another opening at another one of said pair of opposite sides of the inwardly curved closed wall, and another rib attached to the wall adjacent the other opening and extending inwardly therefrom to reinforce an upper portion of said inwardly curved closed wall at said other opening.

17. The portable, safety, play chair of claim 16 in which said upper portion of the wall is made of plastic having a thickness of at least two orders of magnitude less than that of the opening and said one and the other ribs are integrally formed therewith.

18. The portable, safety, play chair of claim 1 including a laterally extending rim inwardly offset relative to the upper portion of the wall around the upper portion of the curved closed wall, and a beveled wall interconnecting the reinforcing rib and the rim.

19. A portable, safety, play furniture assembly, comprising:

a chair body including a smoothly curved wall closed inwardly upon itself to form upper and lower portions between a pair of opposite sides of the curved wall, and an opening at one of said sides of the wall for entry of a person to repose within the curved wall; and a reinforcing rim assembly attached to the wall adjacent the opening including an outwardly turned portion to form at least part of a hand grip for a person to raise or lower themselves through the opening; and a base for supporting the inwardly closed wall against tipping and rolling movement.

20. The portable, safety, play furniture apparatus of claim 19 in which said cylindrical body has another substantially circular opening at the other of said pair of opposite sides of the wall.

21. The portable, safety, play furniture apparatus of claim 20 including another reinforcing rim assembly attached to the cylindrical body adjacent the other substantially circular opening.

22. The portable, safety, play furniture apparatus of claim 21 in which said other rim assembly has a narrowed portion adjacent an upper segment of said circular opening.

23. The portable, safety, play furniture apparatus of claim 19 in which said rim assembly has a segment which gradually varies in width to provide a relatively narrow hand grip at an upper section of the rim assembly and a relatively wider hand grip at a lower section.

24. The portable, safety, play furniture apparatus of claim 23 in which said rib has a depth which gradually varies from a relatively deep level adjacent the relatively narrow hand grip at the relatively upper section of the rim to a relatively shallow level adjacent the relatively wider hand grip at the relatively lower section of the rim.

25. The portable, safety, play furniture apparatus of claim 19 in which said rim assembly has a slanted segment attached to the cylindrical body.

* * * * *